US007574765B2

(12) United States Patent
Huber et al.

(10) Patent No.: US 7,574,765 B2
(45) Date of Patent: Aug. 18, 2009

(54) TOOTHBRUSH AND PROCESS FOR PRODUCING THE SAME

(75) Inventors: Beat Huber, Büron (CH); Franz Fischer, Triengen (CH)

(73) Assignee: Trisa Holding AG, Triengen (CH)

( * ) Notice: Subject to any disclaimer, the term of this patent is extended or adjusted under 35 U.S.C. 154(b) by 0 days.

(21) Appl. No.: 11/878,720

(22) Filed: Jul. 26, 2007

(65) Prior Publication Data

US 2007/0266507 A1 Nov. 22, 2007

Related U.S. Application Data

(60) Division of application No. 10/964,731, filed on Oct. 15, 2004, now Pat. No. 7,418,759, which is a continuation of application No. PCT/CH03/00220, filed on Apr. 2, 2003.

(30) Foreign Application Priority Data

Apr. 15, 2002 (DE) ..... 102 16 641

(51) Int. Cl.
*A46B 13/02* (2006.01)
*A61C 17/22* (2006.01)

(52) U.S. Cl. ..... 15/28; 15/22.1

(58) Field of Classification Search ..... 15/22.1, 15/28

See application file for complete search history.

(56) References Cited

U.S. PATENT DOCUMENTS

| | | | | |
|---|---|---|---|---|
| 1,022,920 A | | 4/1912 | Anderson | |
| 1,142,698 A | | 6/1915 | Grove et al. | |
| 1,588,785 A | | 6/1926 | Van Sant | |
| 1,598,224 A | | 8/1926 | Van Sant | |
| 1,993,763 A | | 3/1935 | Touchstone | |
| 2,042,239 A | | 5/1936 | Planding | |
| 2,139,245 A | | 12/1938 | Ogden | |
| 2,266,195 A | | 12/1941 | Hallock | |
| 2,279,355 A | | 4/1942 | Wilensky | |
| 2,614,556 A | | 10/1952 | Martin | |
| 3,316,576 A | * | 5/1967 | Urbush | 15/22.1 |
| 3,553,759 A | | 1/1971 | Sober et al. | |
| 4,543,679 A | | 10/1985 | Rosofsky et al. | |
| D282,318 S | | 1/1986 | Herzfeld | |
| 4,972,542 A | | 11/1990 | Moshos et al. | |
| 5,283,921 A | * | 2/1994 | Ng | 15/22.1 |
| 5,604,951 A | | 2/1997 | Shipp | |
| 5,689,850 A | * | 11/1997 | Shekalim | 15/22.1 |
| 5,839,148 A | | 11/1998 | Volpenhein | |
| 5,864,915 A | | 2/1999 | Ra | |
| 6,681,777 B2 | | 1/2004 | Gueret | |

FOREIGN PATENT DOCUMENTS

| | | |
|---|---|---|
| DE | 198 57 032 | 7/1999 |
| GB | 438091 | 11/1935 |

* cited by examiner

*Primary Examiner*—Randall Chin
(74) *Attorney, Agent, or Firm*—Oliff & Berridge, PLC

(57) ABSTRACT

The invention relates to a toothbrush with a neck piece and a brush body, comprising a head piece connected thereto, conventional bristles and at least one soft elastic cleaning element. According to the invention, the conventional bristles are mounted on a support element made from hard plastic. The above is connected to the brush body by means of a recess on the head piece which matches the support element. The at least one cleaning element is arranged on the head piece and directly connected to the brush body. The invention further relates to a method for production of such a toothbrush.

28 Claims, 13 Drawing Sheets

4
2
8
3'
3
1
5"
12
1a'
1c
7
7
7
A

4'
3'
12
4
1
2
7
7
7
1a
1c 1
2
3
1c
4
1a 4
2
3'
3'
1
5"
1c
1a'

3'
3'
3
5"
2
1c
1
1a 1
3
4a
2
3
4a
4a
4a
4a
4a
4a
4
4a
4a
3
3
4a
1c
1a

TOOTHBRUSH AND PROCESS FOR PRODUCING THE SAME

This is a Division of application Ser. No. 10/964,731 filed Oct. 15, 2004, now U.S. Pat. No. 7,418,759, which in turn is a Continuation of International Patent Application No. PCT/CH03/00220 filed Apr. 2, 2003. The disclosures of the prior applications are hereby incorporated by reference herein in their entirety.

The invention relates to a toothbrush and to a process which is intended for producing the same.

BACKGROUND

Toothbrushes with a conventional bristle arrangement comprising clusters of bristle filaments, e.g. made of polyamide (PA) or polyester (PBT), and additional flexible cleaning elements are known, for example, from WO-A-00/64307 and WO-A-01/21036. The conventional bristles here serve for customary teeth-cleaning purposes, while the flexible cleaning elements can perform different functions, e.g. massaging the gums, damping the cleaning movement, removing plaque or polishing the surface of the teeth. According to WO-A-00/64307, the flexible cleaning elements are rod-like, are of approximately the same length as the conventional clusters of bristles and are arranged on the periphery of the head part of the toothbrush. In the case of the embodiments disclosed in WO-A-01/21036, the elastic cleaning elements are of sheet-like, e.g. undulating, configuration and are arranged within the conventional bristle arrangement. According to WO-A-00/64307, a plurality of the flexible cleaning elements are connected to one another via a material bridge made of the same material. U.S. Pat. No. 5,628,082 describes a process for producing a toothbrush having conventional bristles and additional flexible cleaning elements.

In accordance with the production process described in U.S. Pat. No. 5,628,082, following the operation of covering the head part of the toothbrush with conventional bristles, the cleaning elements are produced by virtue of the head part being encapsulated by injection molding. The disadvantage here is that the bristle filaments have to be prepared for use, e.g. by virtue of the clusters of bristles being rounded or of a predetermined profiling being produced, before the flexible structure is produced. Renewed insertion into the injection mold is then necessary in order to produce the flexible cleaning element. It is possible for the clusters of bristles to be damaged or soiled during this subsequent machining operation.

SUMMARY

The object is achieved by a toothbrush having a brush body, which has neck part, and/or adjoining head part; a separately-formed carrier element made of hard plastic with bristles fitted on the separately-formed carrier element; a non-bristle-containing flexible cleaning element connected to the brush body via a mount located on the head part, said mount being adapted to receive the separately-formed carrier element, and said flexible cleaning element being arranged on the head part and non-releasably connected to the brush body by multi-component injection molding. The term toothbrush covers both conventional manual toothbrushes and electric teeth-cleaning appliances. The latter may be plug-on parts for electric teeth-cleaning appliances or single-piece electric toothbrushes. Advantageous developments can be gathered from the dependent claims, the description and the drawings.

The object of the invention is thus to provide a toothbrush which has conventional bristles and at least one flexible cleaning element and can be produced such that it is possible to avoid subsequent machining of the bristle-covered toothbrush head. The intention is also to specify a corresponding production process.

The object is achieved by a toothbrush having the features of claim 1 and by a process which is intended for producing such a toothbrush and has the features of claim 10. The term toothbrush covers both conventional manual toothbrushes and electric teeth-cleaning appliances. The latter may be plug-on parts for electric teeth-cleaning appliances or single-piece electric toothbrushes. Advantageous developments can be gathered from the dependent claims, the description and the drawings.

According to the invention, in the case of a toothbrush of the type mentioned in the introduction, at least one flexible cleaning element is connected directly to the brush body on the head part. The conventional bristles are fitted on a carrier element made of hard plastic, this carrier element being produced separately and being provided with conventional bristles before it is connected in a releasable or non-releasable manner to the head part of the brush body. In the connected state, the flexible cleaning element is preferably in close proximity to the carrier element with the conventional bristles. In order to achieve an optimum cleaning performance, and to keep the brush-head dimensions as small as possible, the distance between adjacent conventional bristles on the carrier element and the flexible cleaning elements on the brush body is preferably less than 5 mm. Both the conventional bristles and the flexible cleaning element are thus effective during use. The carrier element and the head part of the brush body are connected via a mount. Depending on the configuration of the carrier element, the mount may be a counter part which complements the carrier element or a coupling element arranged thereon. For example, a shallow cut-out, a pin, a hole or a groove may be used as the mount. A cut-out adapted to the outer shape of the carrier element is recommended, in particular, if a non-releasable connection between the carrier element and brush body is desired. The cleaning elements here are preferably arranged in the border region around the cut-out on the head part. A releasable connection between the carrier element and brush body is desirable in particular in the case of exchangeable-head toothbrushes.

In accordance with the production process according to the invention, the carrier element is produced, and covered with bristles, separately from the rest of the brush body, on which the at least one flexible cleaning element is arranged. The bristles are then preferably cut, rounded or prepared for use in some other way. There are no restrictions as far as the bristle-covering method which is to be selected is concerned, with the result that it is possible to use all the known processes, for example AFT (Anchor Free Tufting), as is known for example from DE-U-200 06 311, IMT (In Mould Tufting), as is known for example from DE-A-38 20 372, or conventional stuffing.

The production of the brush body with at least one flexible cleaning element, and optionally further flexible elements, takes place at a different time and location from the production of the carrier element. In contrast to the conventional bristles, the at least one flexible cleaning element and optionally further flexible elements are connected to the brush body directly, that is to say not via an additional carrier element. The further flexible elements can be used, for example, for the ergonomic adaptation of the handle to the surface of the hand or for providing an elastic region between the head part and neck part. The production of the brush body with one or more flexible cleaning elements and optionally further flexible elements preferably takes place by two-component or multi-component injection molding, it being possible to mold on the various flexible elements, and connect them to the hard component of the brush body, in one step. A non-releasable connection between the components is preferably produced here. The flexible cleaning elements may also be produced via dedicated injection points, in particular if the flexible cleaning elements are to have a color or Shore A hardness which differs from the rest of the flexible elements.

Conventional bristles consist, for example, of polyamide (PA) or polyester (PBT) and have a diameter of 0.1 mm to 0.25 mm. They are combined, for example, in clusters with 10 to 100 individual filaments. For reasons of stability, the flexible cleaning elements, which consist for example of thermoplastic elastomer (TPE), have greater material thicknesses. The smallest dimension of a cross section (for example at 90% of the height of the cleaning element) through such a cleaning element is preferably between 0.5 mm and 3 mm.

The material for the flexible cleaning elements and optionally further flexible elements is preferably fed via a material-distributing channel in the handle or in the neck part. The flexible material here is fed at those points at which the flexible cleaning elements and, if appropriate, further flexible elements are provided. These are formed in corresponding cavities of the injection mold. It is possible for the flexible material, injected for example into a mount intended for accommodating the carrier element, to be guided from the mouth opening of the material-distributing channel to the points of attachment for the flexible cleaning elements. In order to make it possible for the cleaning elements to be injection molded satisfactorily, the material-distributing channel, on the neck part, preferably has a minimal cross section of at least 0.5 $mm^2$. The flexible material is concealed by the carrier element once the latter has been fitted onto the head part of the brush body. The advantage of this production process is that the rear side of the head part does not have any undesirable gate marks or distributing channels. Recesses located in that region on which the carrier plate is to be fitted are preferably used as retaining points for the brush body for transportation between various mold cavities, corresponding to the individual components, during the two-component or multi-component injection molding of the brush body. This may be advantageous in the case of the brush bodies being transported both in a linear manner and in a rotary manner within the injection mold. These recesses in the hard component of the brush body are preferably filled with the material component which is injected last.

In a straightforward further step, the carrier element is connected to the head part of the brush body. It is possible, for example, for connection to take place directly downstream of the injection-molding machine of the brush body, in which case the orientation of the brush bodies following injection molding is maintained and the carrier elements are fed by means of conveyors and fitted. The connection can take place mechanically in a releasable or non-releasable manner. For example, the connection may be produced by clamping, snap-fitting or riveting. The connection may also be produced chemically by adhesive bonding, thermally by welding, in particular ultrasonic welding, or some other supply of heat. It is preferred, in production terms, if the carrier element consists of the same material as the hard components of the brush body since, in this case, only one hard component has to be kept in stock for producing the brush and there is no need to ensure compatibility of materials. This is advantageous, in particular, in the case of ultrasonic welding. It is particularly preferred for the carrier element to be covered with bristles in accordance with AFT (Anchor Free Tufting) technology and to be fully machined before it is connected, by means of ultrasonic welding, to the brush body provided with at least one flexible cleaning element.

The materials used for the carrier element and the hard components of the brush body are, in particular, polypropylene, styrene-acrylonitrile, polyester, polystyrene (PS), acrylonitrile-butadiene-styrene (ABS) or Isoplast®. The flexible elements preferably consist of an, in particular, thermoplastic elastomer, e.g. of natural or synthetic rubber. The Shore A hardness of the soft component is preferably less than 90, and is particularly preferably less than 40. Depending on the type of hard component, a compatible flexible material which connects during injection molding is preferably to be selected.

If a non-releasable connection between the carrier element and brush body is desired, then, once the carrier element has been fitted, the toothbrush is preferably subjected to the action of a testing device installed in the fitting or assembly device. In this case, the carrier element is subjected to a compressive force by means of a pin or of a similar element. If the connection between the carrier element and the brush body is insufficient, it is separated during this step. The brush body may contain regions of flexible material which transmit to the carrier element the compressive force to which they are subjected. It is thus also possible for the consumer, following a relatively long period of use, to check the adherence between the carrier element and brush body, for example by means of pressure applied by a finger or by a simple tool such as a pen. In order that the region made of flexible material is not damaged during testing, its thinnest point preferably has a thickness of at least 0.5 mm.

The testing methods described can also be used on toothbrushes without flexible elements. This is advantageous, in particular, in the case of toothbrushes produced by means of AFT, in order to check the connection between the carrier element and brush body.

The above described production process does away with the problems which arise in the production of toothbrushes with conventional bristles and flexible cleaning elements as a result of the head part being encapsulated by injection molding once bristle covering has taken place. If the flexible cleaning elements are already located in the bristle arrangement as the conventional bristles are machined, then, in accordance with the above-described production process, it is additionally possible to prevent the situation where the flexible cleaning elements are damaged, or contaminated by abrasive dust, during machining of the bristles.

A further advantage in the separate production of the brush body with cleaning element and carrier element with conventional bristles is that it is possible to realize a wide range of shapes for the flexible cleaning elements. For example, it is possible to realize shapes which, in the finally assembled state, are in contact with the conventional bristles or which are displaced when the carrier element is inserted. The separate production means that demolding of the flexible structure does not pose any problems.

In addition, a toothbrush according to the present invention also has advantages from an ecological point of view since, in the case of embodiments in which the carrier element is connected in a releasable manner to the brush body, in particular exchangeable-head toothbrushes, it is easily possible to be exchanged, with the carrier element, that part which wears more quickly. The flexible cleaning elements tend to wear less quickly than the conventional bristles and, thanks to their greater dimensions, are easier to clean. It is thus possible for the flexible cleaning elements to outlast a number of carrier elements without sustaining any damage.

In an advantageous further development, it is possible, in the case of electric teeth-cleaning appliances, for at least one flexible cleaning element to be arranged on the brush body such that the flexible cleaning element is made to move, in particular vibrate, relative to the brush body by the movement of the rotatably mounted carrier element. This can be brought about, for example, in that the carrier element has at least one lateral indent and the cleaning element is positioned in the region of the indent. The cleaning element is thus made to vibrate relative to the brush body by the movement of the carrier element. In a further type of configuration, the cleaning elements are bent such that they project, by way of their region adjacent to the free end, into the bristle arrangement formed by the bristles and, in this way, are made to move relative to the brush body during movement of the bristles. In order to achieve optimum vibration action, and to keep the wear to the flexible cleaning elements minimal, the angle of the latter relative to the axis of rotation of the carrier element is preferably less than 20°. In order that the moving flexible cleaning elements are not subjected to excessive wear at the base, the maximum angle of rotation of the carrier element in relation to the flexible cleaning elements is preferably less than 75°, particularly preferably less than 45°.

Since electrical teeth-cleaning appliances have a weight of up to 300 g and are a number of times heavier than manual toothbrushes, the end zone made of flexible material, this zone feeding in the cleaning elements, is preferably provided with a layer thickness of more than 1 mm, in order to provide a damping action during impact and to reduce the potential for damage.

BRIEF DESCRIPTION OF THE DRAWINGS

Examples of toothbrushes according to the invention are described hereinbelow and illustrated in the drawing, in which, purely schematically.

DETAILED DESCRIPTION OF EMBODIMENTS

Figure 1D:
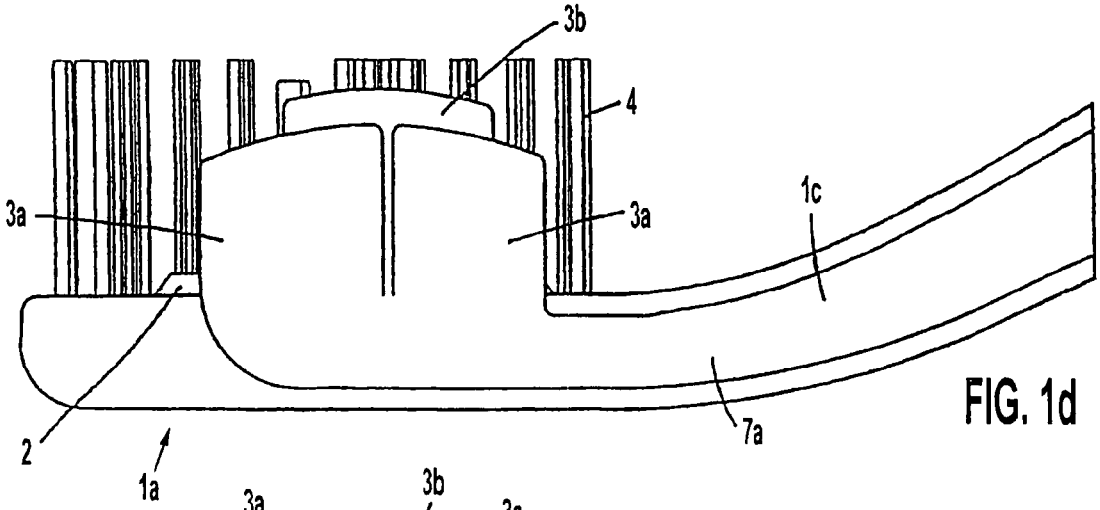
FIG. 1*d* shows a side view of that part of the toothbrush according to the invention, made up of the components depicted in FIGS. 1*a* and 1*b*, which is depicted in FIG. 1*c*, the flexible cleaning elements being illustrated here.

All the toothbrushes illustrated comprise, in the assembled state, a brush body 1 and a carrier element 2 provided with conventional bristles 4. In the case of the manual toothbrushes illustrated (FIGS. 1,2,8-13), the brush body 1 comprises a head part 1*a*', a neck part 1*c* and an adjoining handle 1*d*, as is indicated, for example, in FIGS. 2*a* and 2*c*. In the case of the plug-on parts which are illustrated for electric teeth-cleaning appliances (FIGS. 3-7) and can be plugged onto a handle, the brush body 1 comprises a head part 1*a*' and a neck part 1*c*. Single-piece electric toothbrushes additionally comprise a handle adjoining the neck part. Furthermore, conventional bristles 4 and at least one flexible cleaning element 3, which may be shaped in different ways, are present on the head part 1*a* of the fully assembled toothbrush. The conventional bristles 4 are fitted, in clusters of bristles, on a carrier element 2 which consists of hard plastic and is connected to the brush body 1 via a mount 5. It is only the special features of the individual exemplary embodiments which are discussed hereinbelow, and elements which correspond to one another are provided with the same designations.

Figure 1C:
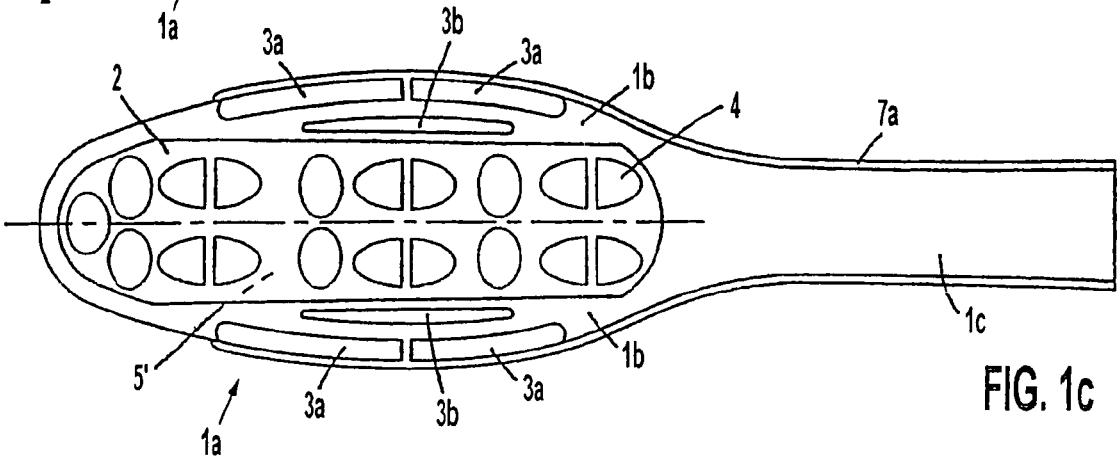
FIG. 1*c* shows a plan view of a front part of a toothbrush according to the invention which is made up of the components depicted in FIGS. 1*a* and 1*b*, the flexible cleaning elements being illustrated here.
Figure 1B:
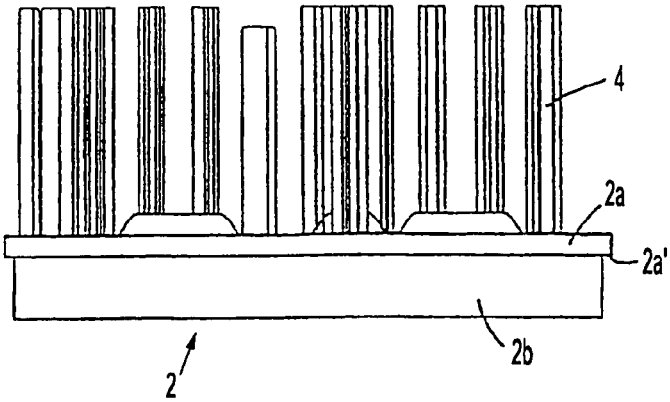
FIG. 1*b* shows the side view of a bristle-covered carrier element which is adapted to the brush body which is partially illustrated in FIG. 1*a;*
Figure 1A:
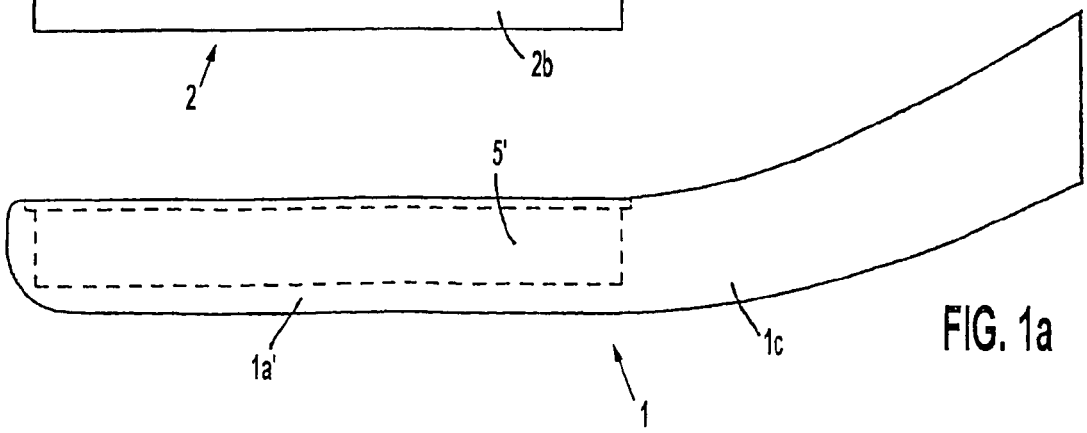
FIG. 1*a* shows part of a brush body in side view, in which, for the sake of clarity, the flexible cleaning elements are not illustrated.

FIG. 1*a* shows a front part of a brush body 1, which for the sake of clarity is illustrated without a flexible cleaning element, prior to being assembled with a carrier element 2 already provided with bristles 4. The carrier element 2 depicted in FIG. 1*b* is provided with conventional bristles 4 which have been fully machined. The AFT (Anchor Free Tufting) method is preferably used for the bristle-covering operation. The carrier element 2 is in the form of a plate 2*a* with a border 2*a*' projecting beyond a peripheral side wall 2*b*, and is adapted to the dimensions of a region prepared in the form of a shallow cut-out 5' in the head part 1*a*' of the brush body 1. The carrier element 2 is preferably connected to the brush body 1 in a non-releasable manner, for example by adhesive bonding or ultrasonic welding. FIGS. 1*c* and *d* show a toothbrush according to the invention comprising a brush body 1 with flexible cleaning elements 3*a*, 3*b* and a carrier element 2 provided with conventional bristles 4, the flexible cleaning elements 3*a*, 3*b*, in the form of lamellae, being connected directly to the head part 1*a* of the brush body 1 according to FIG. 1*a*. These lamellar cleaning elements 3*a*, 3*b* are arranged in the lateral border regions 1*b* around the cut-out 5'. Outer cleaning elements 3*a* are arranged essentially parallel to the outer contour of the head part 1*a* and continue in a flexible covering 7*a* which runs laterally on the neck part 1*c* in the direction of the handle. An inner cleaning element 3*b* is oriented essentially parallel to the side wall 2*b* of the carrier element 2. The cleaning elements 3*a*, 3*b* project from the head part 1*a* parallel to the direction of the bristles 4. In order to ensure the smallest possible distance of less than 5 mm between conventional bristles and cleaning elements, it may be necessary for the flexible cleaning elements 3 to be displaced prior to the bristle-covered carrier element 2 being inserted into the head part 1*a* of the brush body 1.

Figure 2A:
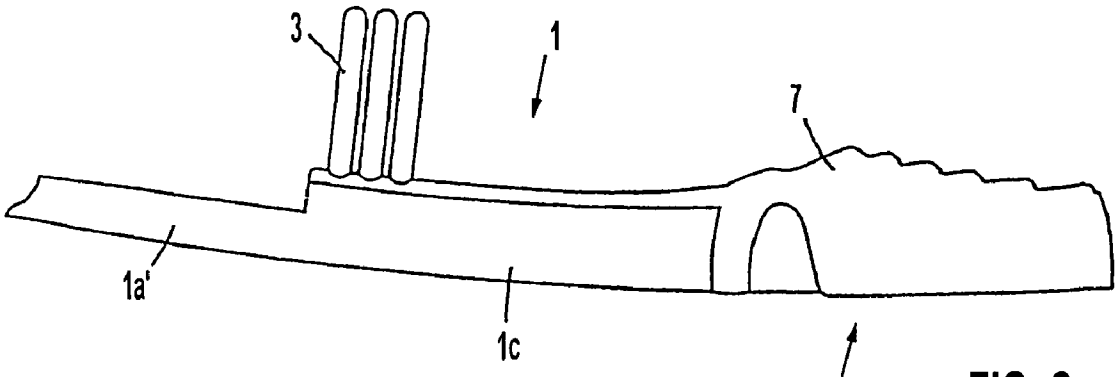
FIG. 2*a* shows a side view of a front part of a brush body of an exchangeable-head toothbrush with flexible cleaning elements.
Figure 2B:
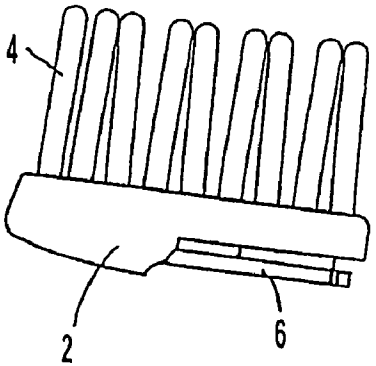
FIG. 2*b* shows a side view of an exchangeable head which is provided with conventional bristles and is intended for the brush body which is partially illustrated in FIG. 2*a;*

FIG. 2*a* shows the front part of a brush body 1 of an exchangeable-head toothbrush. The flexible cleaning elements 3 here are arranged on that side of the head part 1*a*' of the brush body 1 which is directed toward the neck part 1*c*. The corresponding carrier element 2, which is already provided with bristles 4 and constitutes the exchangeable head, is depicted in FIG. 2*b*. The carrier element 2 can be pushed, by means of a guide strip 6, into a longitudinal guide (not shown) on the front part of the brush body 1, this guide running in the longitudinal direction of the brush body 1. In the end position shown in FIG. 2*c*, the carrier element 2 is fixed against displacement in the longitudinal direction by means of a releasable snap-fitting connection (not shown), as is disclosed for example in WO-A-98/01055.

Figure 2C:
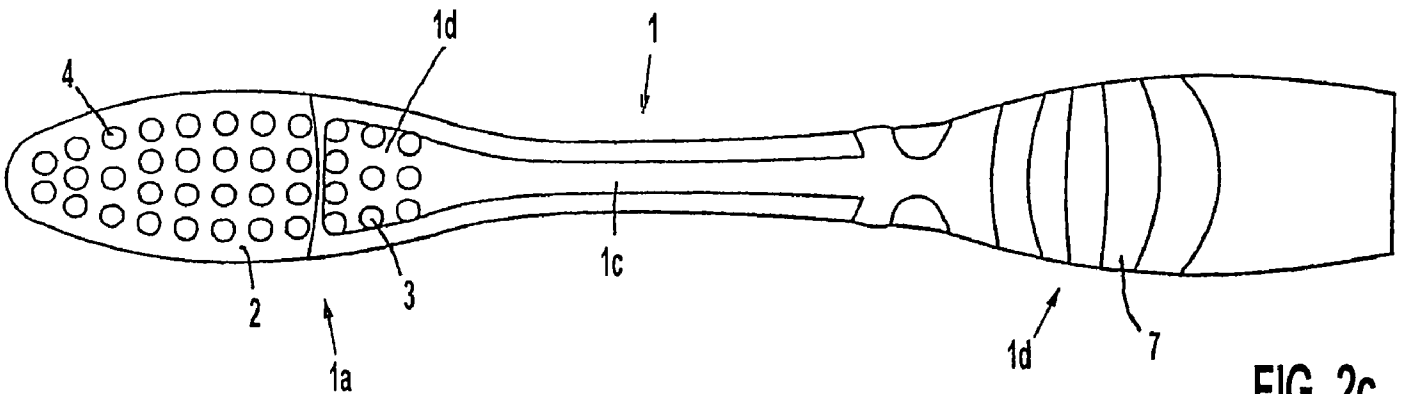
FIG. 2*c* shows a plan view of a front part of a toothbrush which is made up of the components illustrated in FIGS. 2*a* and 2*b;*

The flexible cleaning elements 3 are arranged in a rod-like manner on that side of the head part 1*a* of the brush body 1 which is directed toward the neck part 1*c*. The neck part 1*c* and the handle 1*d* are additionally profiled by a further flexible structure 7, which is preferably produced by two-component or multi-component injection molding, and connected to the hard component of the brush body 1, in the same step as the flexible cleaning elements 3. FIG. 2*c* shows the plan view of the exchangeable-head toothbrush made up of the brush body 1 and carrier element 2. In the assembled state, the carrier element 2 provided with conventional bristles 4 forms the front tip of the toothbrush according to the invention.

Figures 3A, 3B, 3C, 3D:
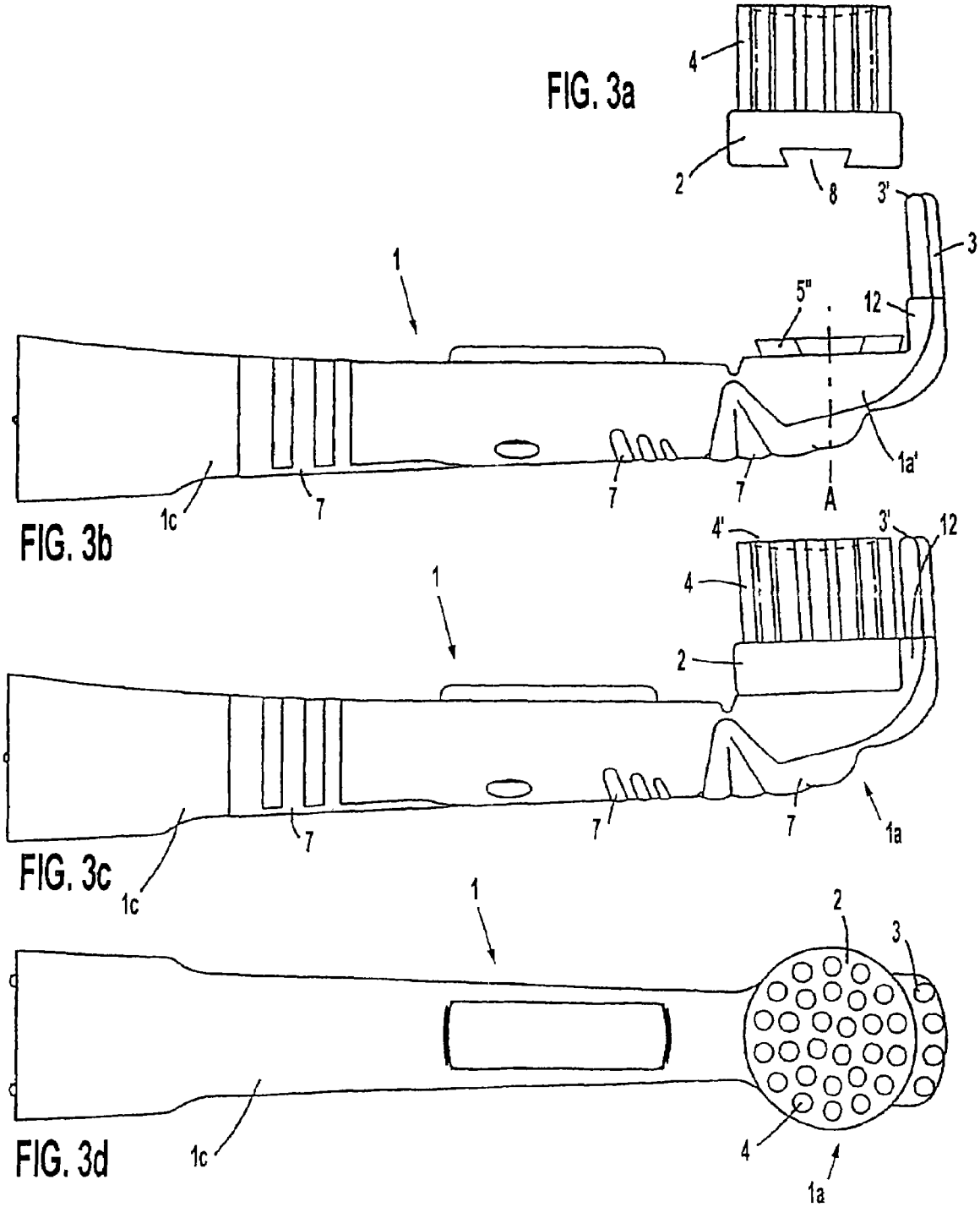
FIG. 3*a* shows a side view of a bristle-covered carrier element for a plug-on part of an electric teeth-cleaning appliance.
FIG. 3*b* shows a side view of a brush body which is intended for combining with the carrier element according to FIG. 3*a* and belongs to a plug-on part according to the invention for an electric teeth-cleaning appliance, rod-like flexible cleaning elements being arranged in the region of the free end of the head part.
FIG. 3*c* shows a side view of a plug-on part according to the invention which is made up of the components illustrated in FIGS. 3*a* and 3*b;*
FIG. 3*d* shows a plan view of the plug-on part which is illustrated in FIG. 3*c* and is made up of the components illustrated in FIGS. 3*a* and 3*b;*

FIG. 3*a* shows a carrier element 2, already provided with bristles 4, in the form of a circular plate prior to being fitted onto the brush body 1 which is depicted in FIG. 3*b* and belongs to a plug-on part for an electric teeth-cleaning appliance. Rod-like flexible cleaning elements 3 are connected directly to the brush body 1 in the region of the free end of the head part 1*a*, as can be seen from FIG. 3*b*. The carrier element 2 is connected to the adapted head part 1*a*' of the brush body 1, or to a rotary disc 5" fastened thereon such that it can be rotated about the axis A, in a generally known manner via a snap-fitting connection to form the plug-on part shown in FIGS. 3*c* and 3*d*. For this purpose, the carrier element 2 has, on the side which is directed away from the bristles 4, a groove 8 in which the mating element on the rotary disc 5" engages and which serves for rotary driving action. The flexible cleaning elements 3 are of rod-like design and are arranged on an extension 12 of the brush body 1, this extension being located at the free end of the head part 1*a* and, with the toothbrush fully assembled, being level with the carrier element 2. The extension 12 is arcuate in plan view and adapted to the shape of the carrier element 2, with the result that the latter can rotate freely. The rotary disc 5" and the carrier element 2 fastened thereon are moved back and forth via a generally known drive (not shown) during use. In the fully assembled state, the bristles 4 and the cleaning elements 3 are oriented parallel to one another. The free ends 3' of the cleaning elements 3 here are essentially flush with the free end 4' of the bristles 4. Furthermore, further flexible structures 7 are formed on the neck part 1*c* and in the region between the neck part 1*c* and head part 1*a*, as FIGS. 3*b* and *c* show.

Figure 4A:
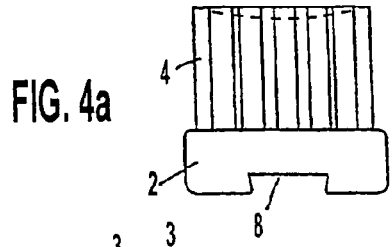
FIG. 4*a* shows a side view of a bristle-covered carrier element corresponding to FIG. 3*a;*
Figure 4B:
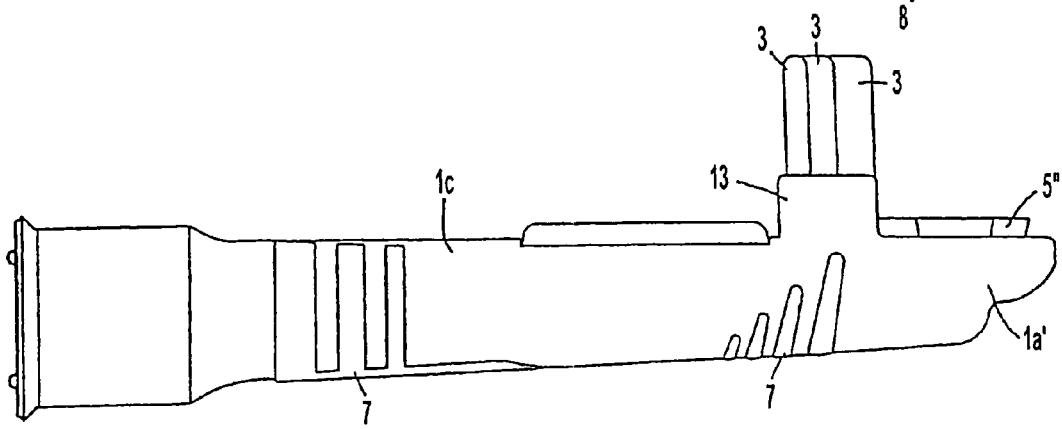
FIG. 4*b* shows a side view of a brush body which is intended for combining with the carrier element according to FIG. 4*a* and belongs to a further plug-on part for an electric teeth-cleaning appliance, lamellar flexible cleaning elements being arranged on that side of the head part which is directed toward the neck part.
Figure 4C:
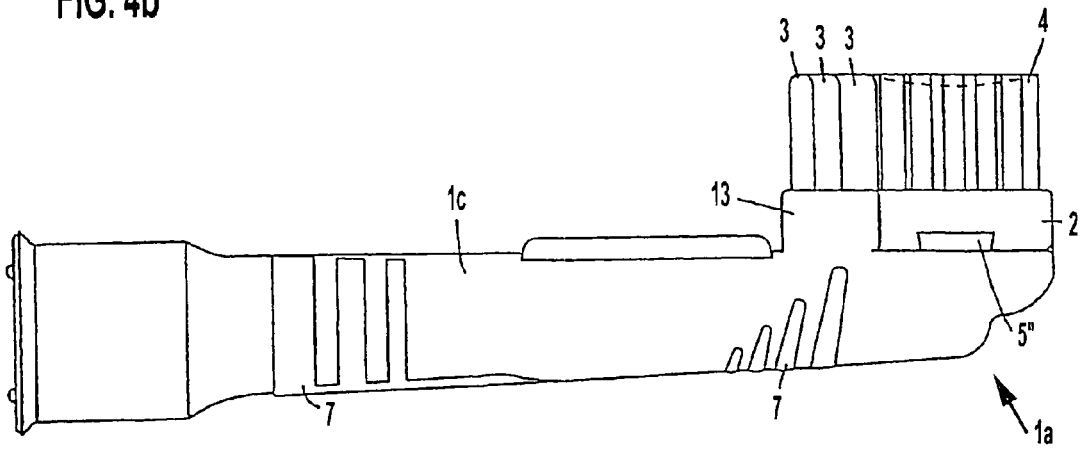
FIG. 4*c* shows a side view of a plug-on part according to the invention which is made up of the components illustrated in FIGS. 4*a* and 4*b;*
Figure 4D:
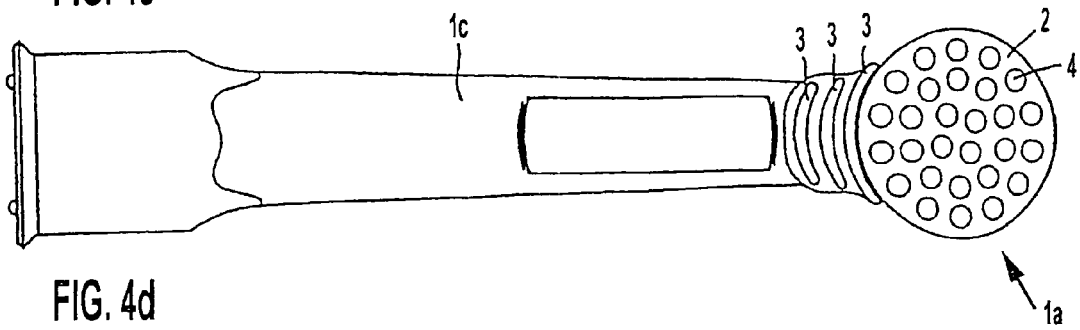
FIG. 4*d* shows a plan view of the plug-on part according to the invention which is illustrated in FIG. 4*c* and is made up of the components illustrated in FIGS. 4*a* and 4*b;*

FIG. 4*a* shows a carrier element 2 which is provided with bristles 4 and is analogous to the carrier element in FIG. 3*a*. The connection between the carrier element 2 and the rotary disc 5" on the plug-on part illustrated in FIG. 4*b* is produced in a manner analogous to that which has been described for FIGS. 3*a* and *b*. As can be seen from FIGS. 4*c* and *d*, in the case of this further embodiment of a plug-on part according to the invention, three lamellar flexible cleaning elements 3, which are bent coaxially with a circular carrier element in plan view, are arranged one behind the other and fitted on an extension 13 on that side of the head part 1*a* which is directed toward the neck part 1*c*. Furthermore, further flexible structures 7 are formed on the neck part 1*c* and in the region between the neck part 1*c* and head part 1*a*, as FIGS. 4*b* and *c* show. In this embodiment, the flexible cleaning elements 3 are preferably fed in via material channels (not shown) in the interior of the plug-on part it also being possible for these channels to be used for producing other flexible structures.

Figure 5A:
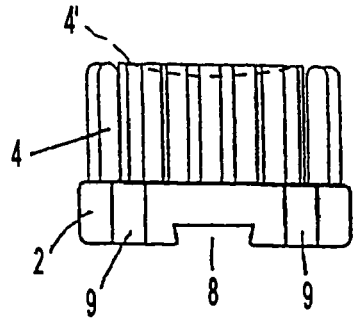
FIG. 5*a* shows a side view of a bristle-covered carrier element for a further plug-on part of an electric teeth-cleaning appliance, with recesses for flexible cleaning elements.
Figure 5B:
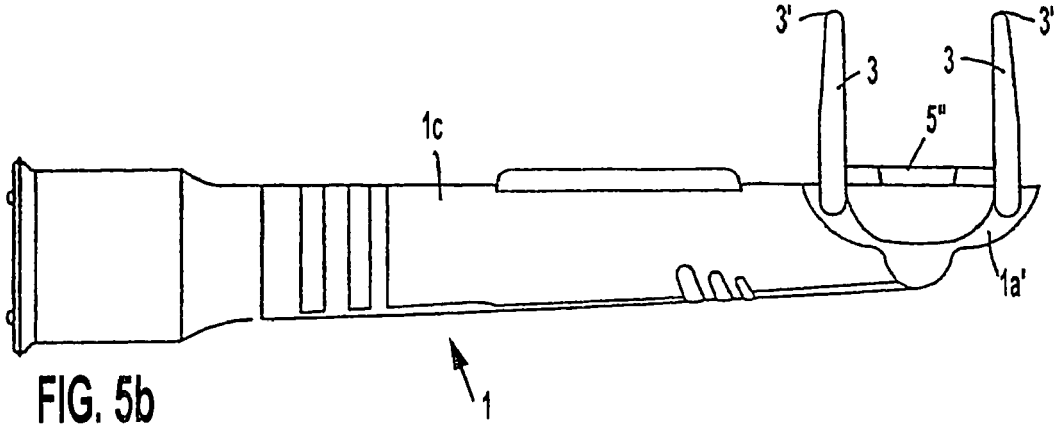
FIG. 5*b* shows a side view of a brush body which is intended for combining with the carrier element according to FIG. 5*a* and belongs to a further plug-on part according to the invention for an electric teeth-cleaning appliance, rod-like cleaning elements being arranged around a rotary disc on the head part of the brush body.
Figure 5C:
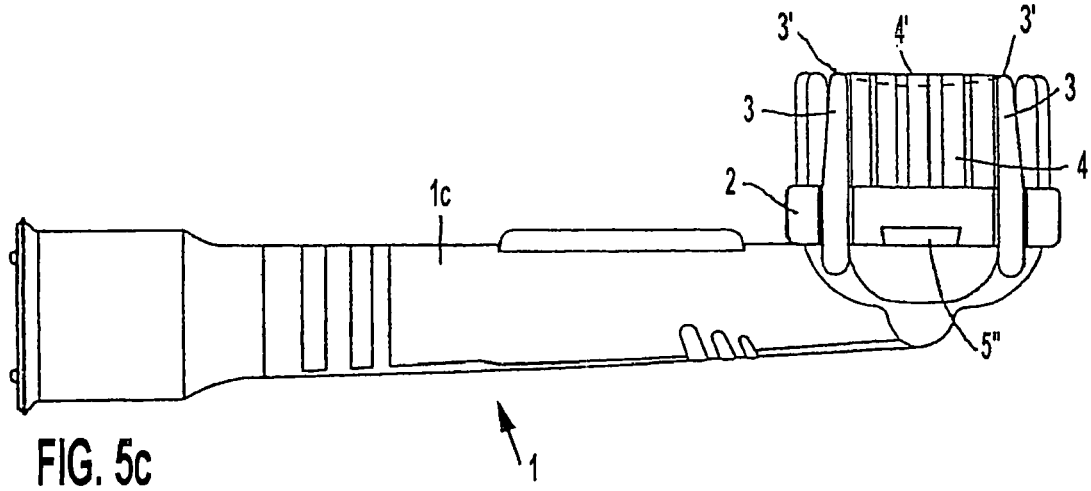
FIG. 5*c* shows the side view of a plug-on part according to the invention made up of the components illustrated in FIGS. 5*a* and 5*b*, the flexible cleaning elements being made to vibrate during use by interaction with the carrier element.
Figure 5D:
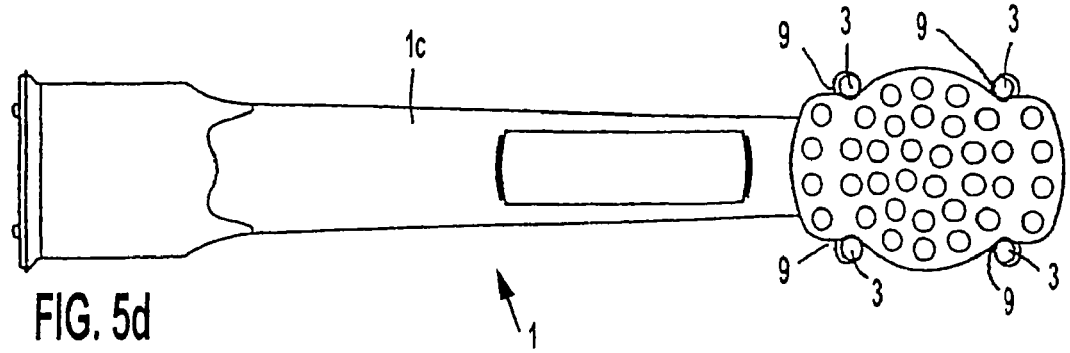
FIG. 5*d* shows a plan view of the plug-on part according to the invention illustrated in FIG. 5*c;*

FIG. 5*a* shows the side view of an essentially elliptical bristle-covered carrier element 2 with four lateral indents 9. The connection between the carrier element 2 and the rotary disc 5" of the brush body 1, this rotary disc being illustrated in FIG. 5*b*, is produced via a generally known snap-fitting connection. Four rod-like flexible cleaning elements 3 are arranged on the head part 1*a'* of the brush body 1, illustrated in FIG. 5*b*, around the rotary disc 5". FIGS. 5*c* and *d* show a side view and plan view of the fully assembled plug-on part for an electric teeth-cleaning appliance. The four rod-like cleaning elements 3, which are bent inward to a slight extent and taper in the direction of the free ends 3', are arranged laterally on the head part 1*a'* of the brush body 1 such that, once the carrier element 2 has been fitted, they are arranged in the region of in each case one of the four indents 9, as can be seen from FIGS. 5*c* and *d*. During use, the rotary disc 5" is made to rotate in an alternating manner via a drive (not shown), this rotation being transmitted to the carrier element 2. The flexible cleaning elements 3, which are arranged laterally on the head part 1*a'* in the region of the indents 9, are made to vibrate by this carrier element striking against them.

Figure 6A:
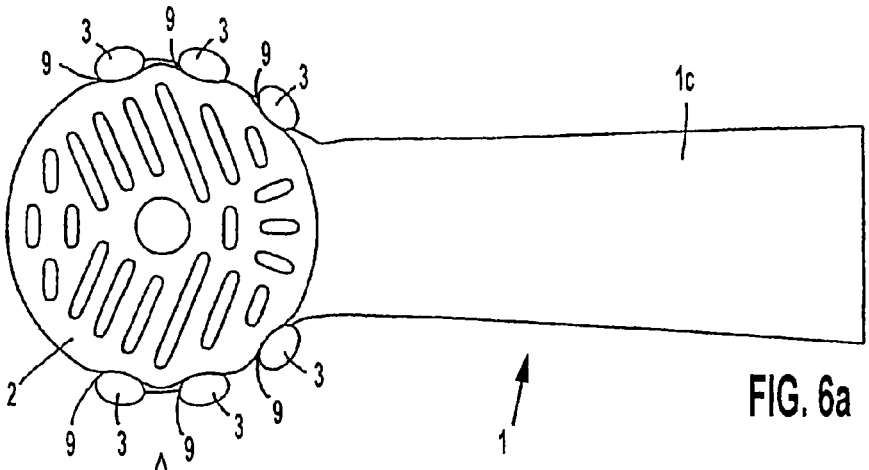
FIG. 6*a* shows a plan view of a front part of a further embodiment of a plug-on part.
Figure 6B:
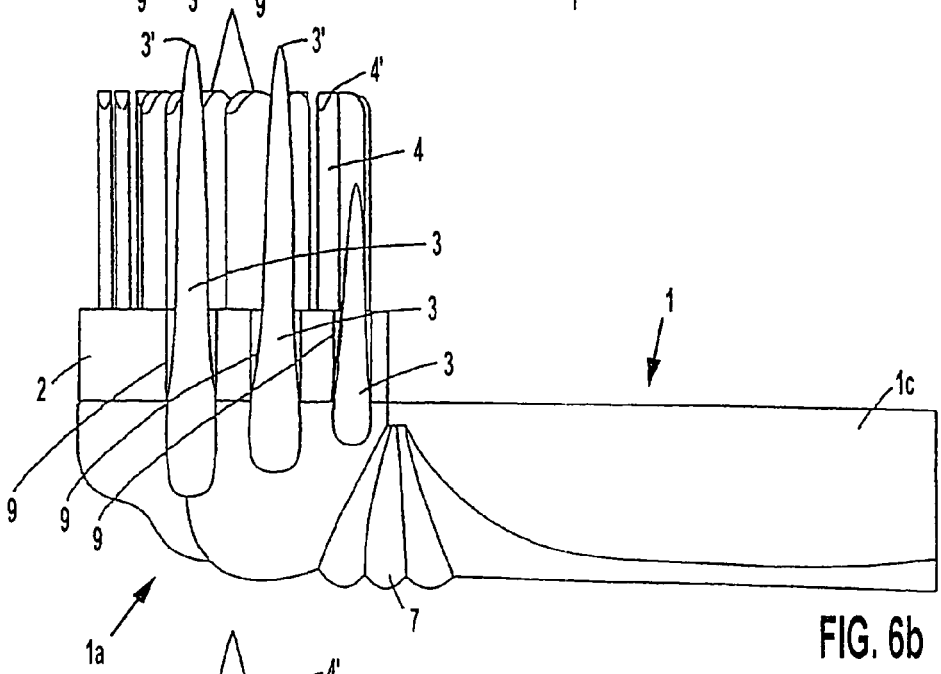
FIG. 6*b* shows a side view of the front part of the plug-on part which is depicted in FIG. 6*a;*
Figure 6C:
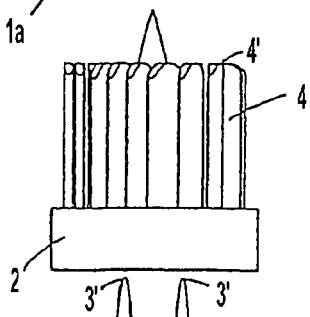
FIG. 6*c* shows a side view solely of the carrier element, provided with bristles, of the embodiment illustrated in FIGS. 6*a* and *b;*
Figure 6D:
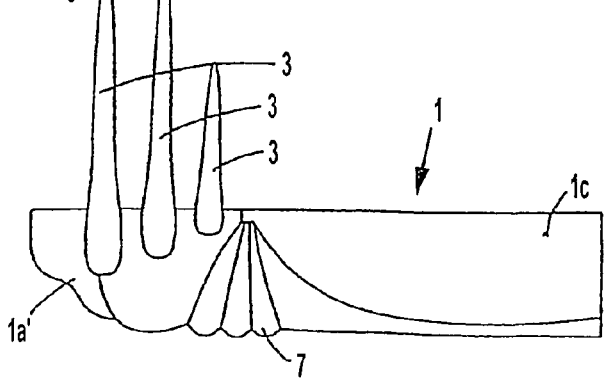
FIG. 6*d* shows a side view of a front part of the brush body of the embodiment illustrated in FIGS. 6*a* and *b*, this brush body being provided with flexible cleaning elements.

In the case of that part of a plug-on part for an electric teeth-cleaning appliance which is illustrated in FIGS. 6*a* and *b*, an essentially circular carrier element 2 with lateral indents 9 is connected to the brush body 1. In this embodiment, the carrier plate is provided with clusters of bristles of different shapes and sizes. A plurality of rectangular clusters directed toward the center of rotation perform the function of cleaning the surface of the teeth. An upwardly tapering cluster which is arranged in the center, and projects beyond the other clusters, performs the function of cleaning in between the teeth. The cleaning elements 3, which taper in the direction of the free ends 3', are arranged laterally on the head part 1*a* of the brush body 1 such that, once the carrier element 2 illustrated in FIG. 6*c*, and already provided with bristles 4, has been fitted onto the brush body 1 illustrated in FIG. 6*d*, are arranged in the regions of the indents 9. In a manner analogous to the embodiment illustrated in FIGS. 5*c* and *d*, the carrier element 2 is made to move back and forth by a drive (not shown), in which case the six flexible cleaning elements 3, which are arranged laterally on the head part 1*a* in the region of in each case one of the six indents 9, are made to vibrate. In the assembled state, the free ends 3' of the flexible cleaning elements 3 project beyond the free ends 4' of the conventional bristles 4. Formed in the region between the neck part 1*c* and head part 1*a* is a further flexible structure 7 for increasing the elasticity in this region.

Figures 7A, 7B, 7C, 7D:
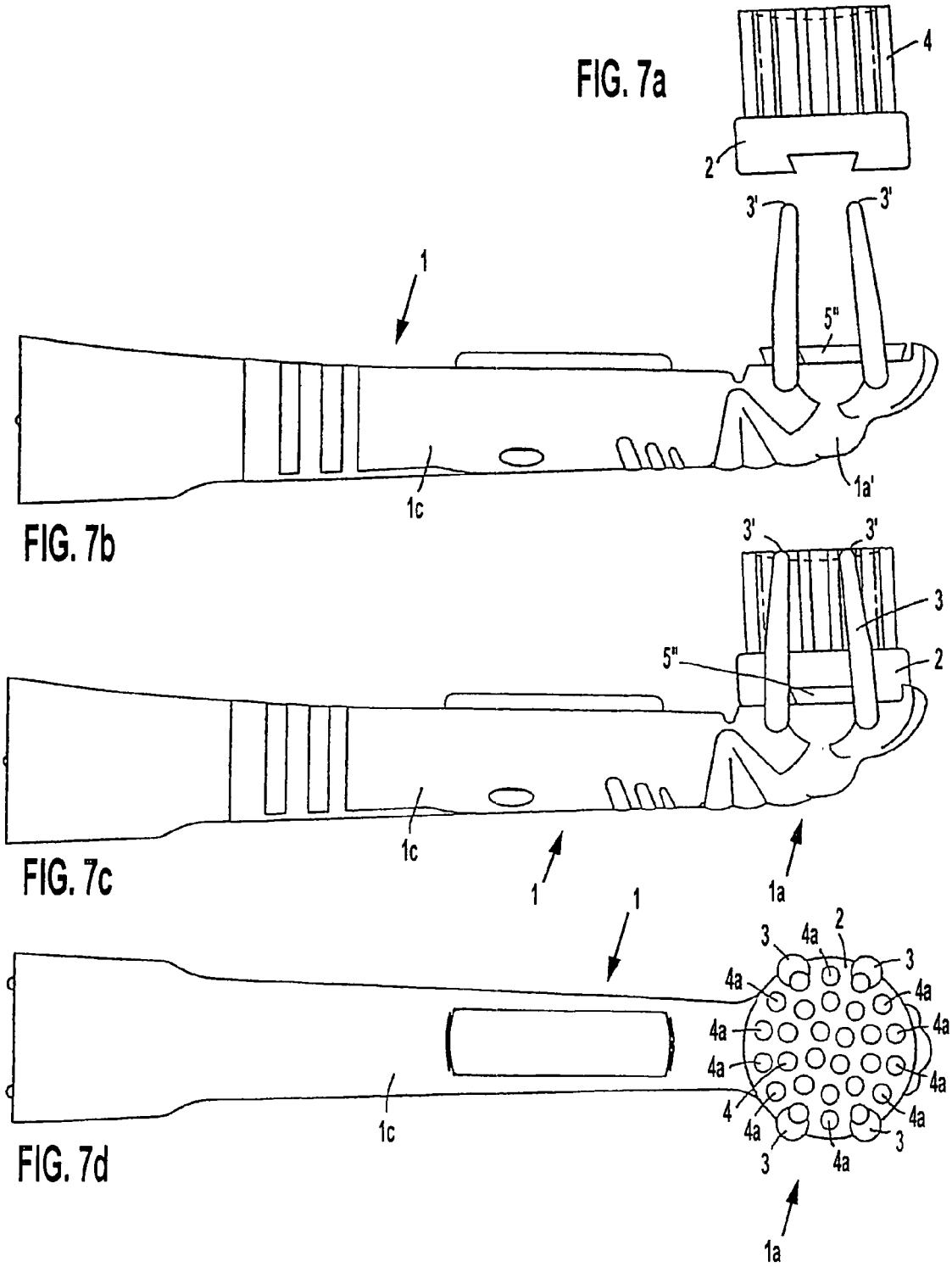
FIG. 7*a* shows a side view of a bristle-covered carrier element for a further plug-on part of an electric teeth-cleaning appliance.
FIG. 7*b* shows a side view of a brush body which is intended for combining with the carrier element according to FIG. 7*a* and belongs to a further plug-on part for an electric teeth-cleaning appliance, flexible cleaning elements being arranged around a rotary disc on the brush body.
FIG. 7*c* shows a side view of the plug-on part according to the invention made up of the components illustrated in FIGS. 7*a* and 7*b*, the cleaning elements being made to vibrate during use by interaction with the bristles.
FIG. 7*d* shows a plan view of the plug-in part according to the invention illustrated in FIG. 7*c;*

FIG. 7*a* shows an essentially circular conventionally bristle-covered carrier element 2. The connection between the carrier element 2 and the rotary disc 5" of the brush body 1, this rotary disc being illustrated in FIG. 7*b*, is produced via a generally known snap-fitting connection. FIGS. 7*c* and *d* depict a side view and plan view of the plug-on part according to the invention following assembly of the components illustrated in FIGS. 7*a* and *b*. The cleaning elements 3 taper in the direction of the free end 3' and are bent inward to a slight extent. They are connected to the head part 1*a* of the brush body 1 such that, once the carrier element 2 illustrated in FIG. 7*a*, and already provided with bristles 4, has been fitted, they project into the bristle arrangement formed by the bristles 4. During operation, the movement of the carrier element 2 is transmitted to the cleaning elements 3 via the peripheral bristles 4*a*.

Figure 8A:
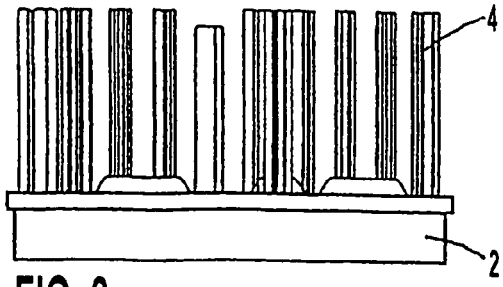
FIG. 8*a* shows a side view of a further bristle-covered carrier element with indents for flexible cleaning elements.
Figure 8B:
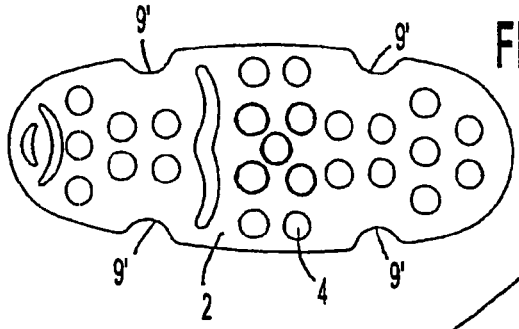
FIG. 8*b* shows a plan view of the carrier element shown in FIG. 8*a;*
Figure 8C:
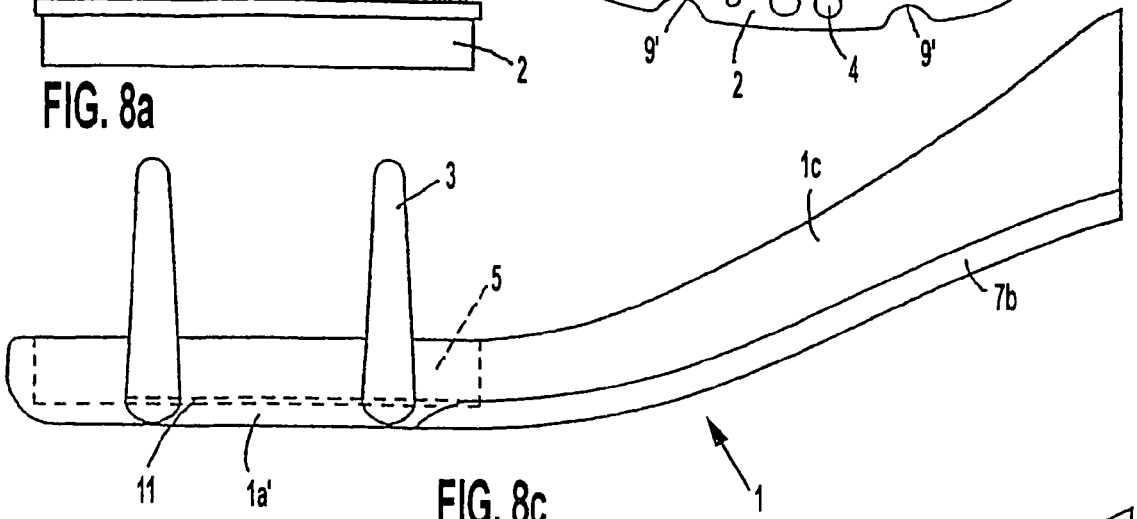
FIG. 8*c* shows a side view of a front part of a brush body intended for combining with the carrier element according to FIGS. 8*a* and *b;*
Figure 8D:
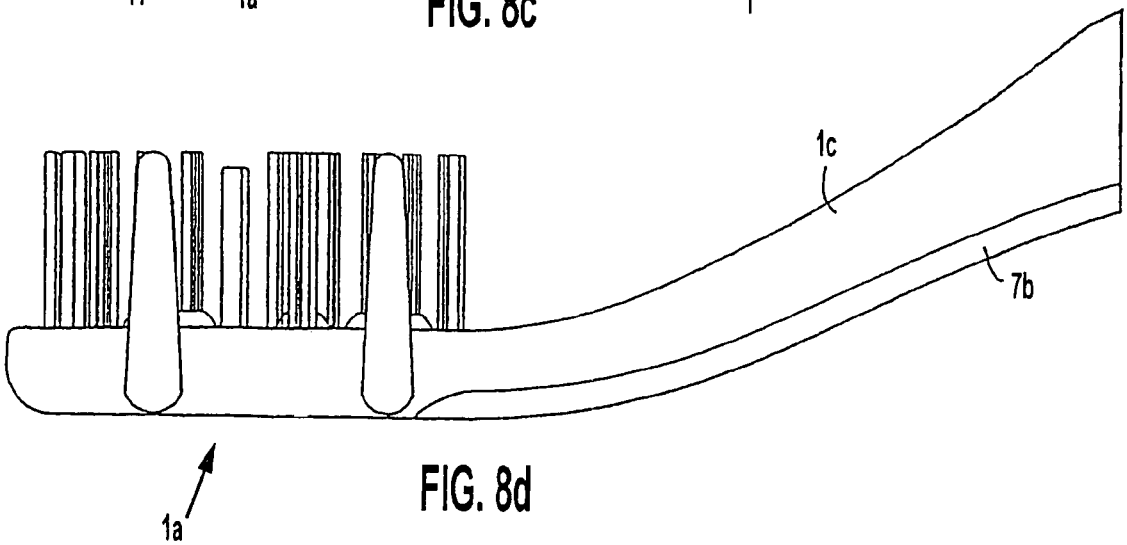
FIG. 8*d* shows a side view of the front part of a toothbrush according to the invention which is made up of the components depicted in FIGS. 8*a* and 8*c;*
Figure 8E:
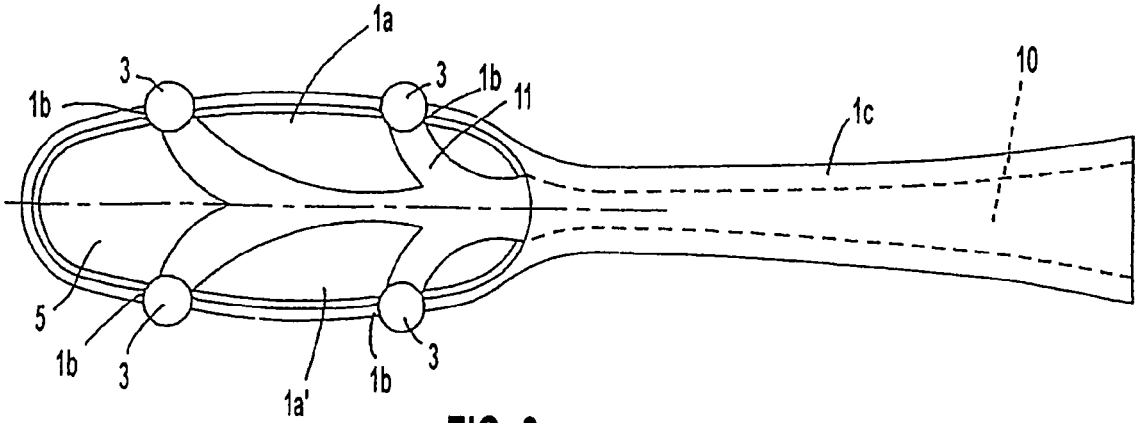
FIG. 8*e* shows a plan view of that part of the brush body which is depicted in FIG. 8*c;*

FIGS. 8*a* and *b* represent a side view and plan view of a carrier element 2 provided with bristles 4. The carrier element of this embodiment has clusters of bristles of different shapes and sizes. The round clusters serve for surface cleaning and the elongate clusters serve for cleaning in between the teeth. As can be seen from the plan view, the oval carrier element 2 has lateral indents 9' for flexible cleaning elements. FIG. 8*c* shows the front part of a finished brush body prior to the carrier element shown in FIGS. 8*a* and *b* being fitted, while FIG. 8*d* represents the front part of a fully assembled manual toothbrush according to the invention. The brush body 1 is preferably produced with flexible cleaning elements 3 by two-component or multi-component injection molding. In this case, flexible material is fed via a material-distributing channel 10, which is indicated in FIG. 8*e* and runs along the neck part 1*c*. The flexible material 11 is directed, in the mount 5, to the points provided for the cleaning elements 3 and is molded in corresponding cavities. The points provided are arranged in the border region 1*b* around the mount 5. As can be seen from FIG. 8*e*, the cleaning elements 3, in plan view, project beyond that surface area of the head part 1*a'* of the brush body which is formed by the hard component. FIGS. 8*c* and *e* show the brush body 1 following completion of injection molding. The side view represented in FIG. 8*c* shows a flexible covering 7*b* on the neck part 1*c* of the brush body 1, this covering having been introduced into the material-distributing channel 10. The exposed flexible material 11 in the head part 1*a'* of the brush body, or on the base of the mount 5, which is shown in FIG. 8*e* is concealed by the carrier element 2 illustrated in FIGS. 8*a* and *b*, and already provided with bristles 4, once the carrier element has been fitted onto the head part 1*a*' of the brush body 1.

Figure 9A:
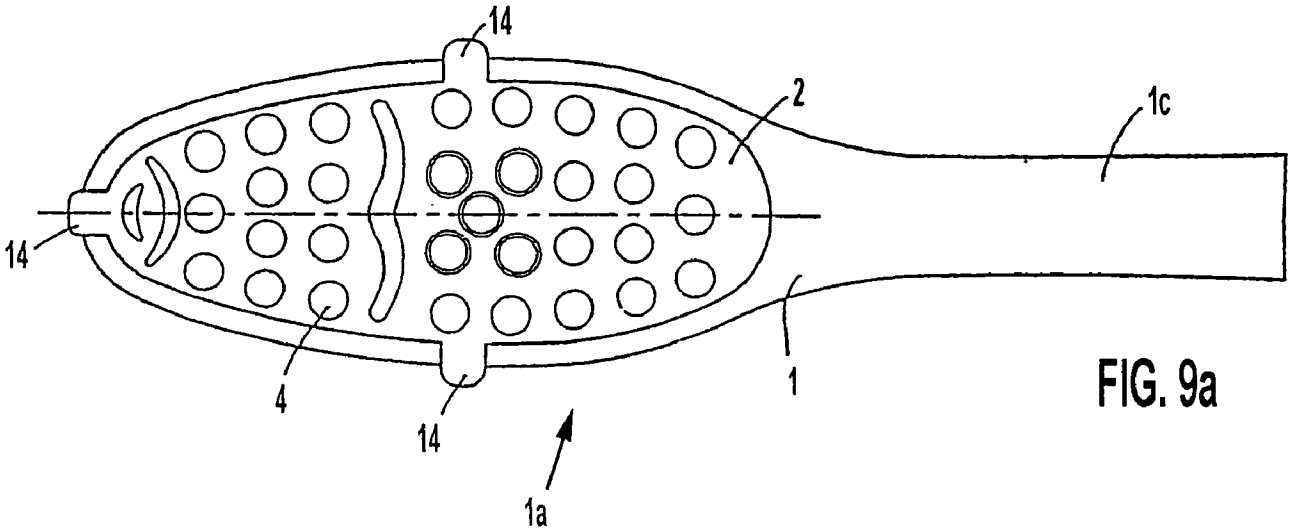
FIG. 9*a* shows a plan view of a part of a toothbrush according to the invention with lateral extensions on the carrier element, the flexible cleaning elements, for the sake of clarity, not being illustrated.
Figure 9B:
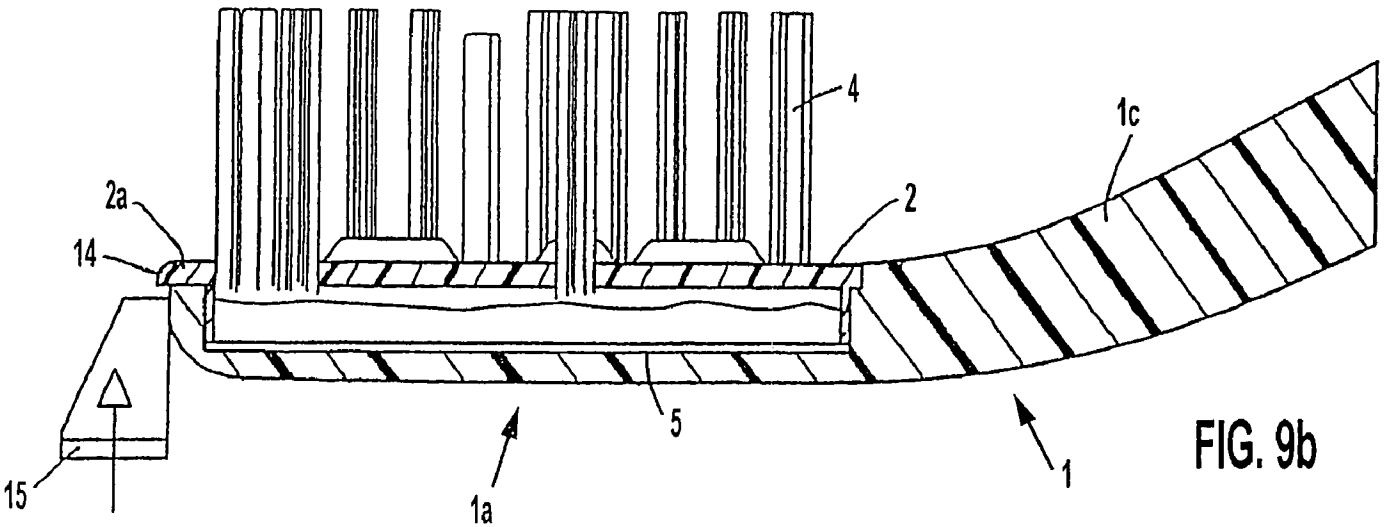
FIG. 9*b* shows a section through the longitudinal center plane of that part of the toothbrush which is illustrated in FIG. 9*a*, the toothbrush being subjected to the action of an assembly-testing device.

FIG. 9*a* shows the front part of a toothbrush made up of the brush body 1 and carrier element 2, the flexible cleaning elements, for reasons of clarity, not being shown. The flexible material on the base of the mount 5 is fed in through a through-passage (not shown) at the end of the neck part 1*c*, this through-passage opening out into the mount 5. For this purpose, a through-passage is produced beforehand at an appropriate point in the hard component of the brush body 1. The toothbrush according to the invention is subjected to the action of a testing device installed in the fitting or assembly device, as is indicated in FIG. 9*b*. In this case, tongues 14 projecting beyond the head part 1*a* are subjected to a certain compressive force by means of pins 15. The tongues 14 constitute lateral extensions of the plate 2*a* of the carrier element 2. The compressive force is applied to all three tongues 14 simultaneously, this being represented, for reasons of clarity, only for the tongue at the front end of the toothbrush. If a non-releasable connection between the brush body 1 and the carrier element 2 provided with bristles 4 is desired, then assembly is regarded as being successful if the carrier element 2 does not jump out of the mount 5 of the brush body 1. The tongues 14 are arranged laterally and at the tip of the head part 1*a*, as can be seen from FIG. 9*a*. It is also possible for the carrier element to project beyond the mount with different shaping, and at some other point, in order to allow corresponding testing during the production process or corresponding testing carried out manually by the consumer. Testing during the production process is advantageously carried out immediately once the carrier plate has been fitted, and is automatically linked with fitting or assembly.

Figure 10B:
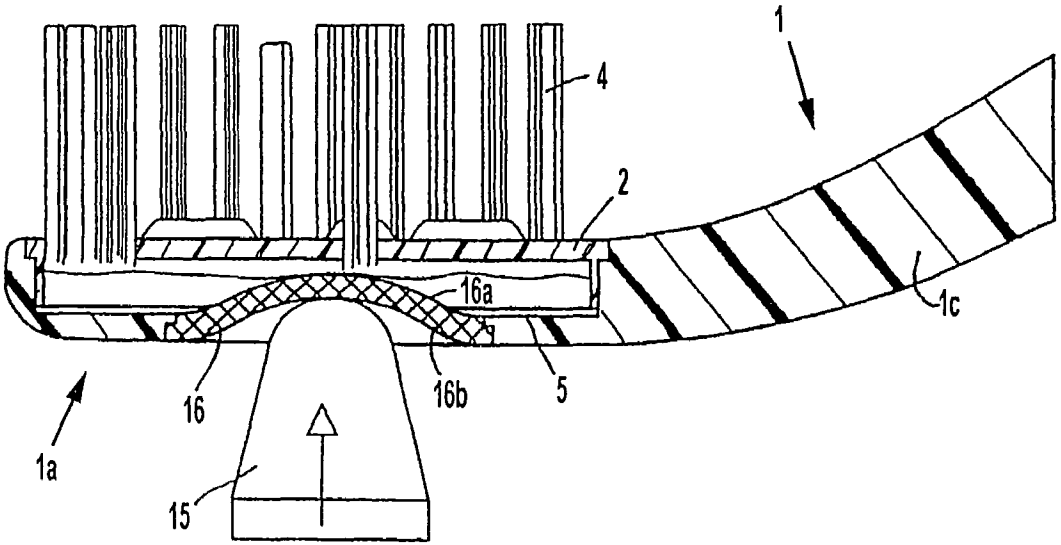
FIG. 10*b* shows a section through the longitudinal center plane of that part of a toothbrush which is depicted in FIG. 10*a*, the toothbrush being subjected to the action of a further assembly-testing device.
Figure 10A:
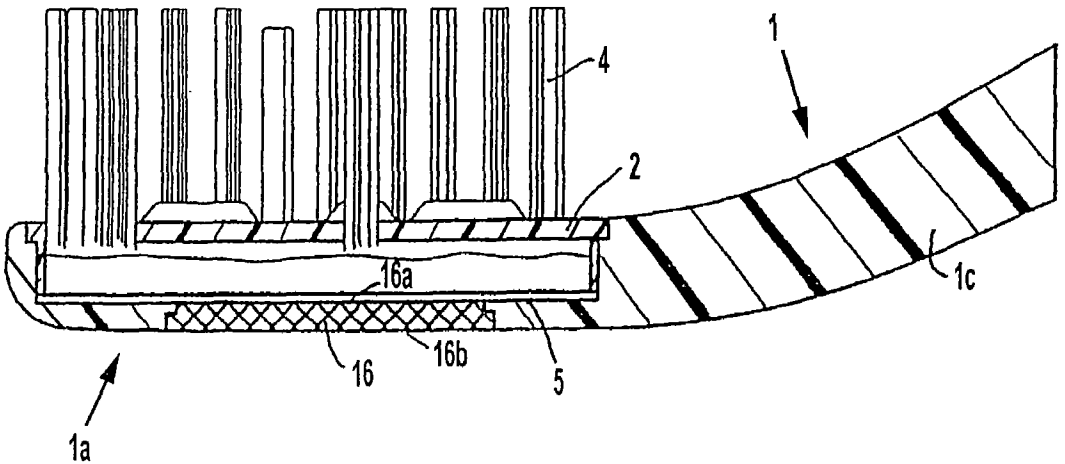
FIG. 10*a* shows a section through the longitudinal center plane of a part of a toothbrush according to the invention with a flexible zone in the brush body, the flexible cleaning elements, for the sake of clarity, not being illustrated.

Further possible ways of testing the fastening of the carrier element 2 in the mount 5 are illustrated in the following figures:

FIG. 10*a* shows the front part of a further toothbrush according to the invention, in the case of which, for reasons of clarity, the flexible cleaning elements are not shown. As can be seen from FIG. 10*a*, part of the head part 1*a* of the brush body 1, in the region of the mount 5, consists of flexible material which forms a flexible zone 16. The flexible zone 16 is of stepped design in section, with the result that the surface of the zone 16 on the side 16*a* which is directed toward the carrier element 2 is smaller than the zone surface on the side 16*b* which is directed away from the carrier element. In the testing device, a pin 15 applies a certain compressive force directly to the flexible zone 16 and indirectly to the carrier element 2, as FIG. 10*b* shows. The compressive force is oriented essentially orthogonally to the longitudinal axis of the head part 1*a*.

Figure 11B:
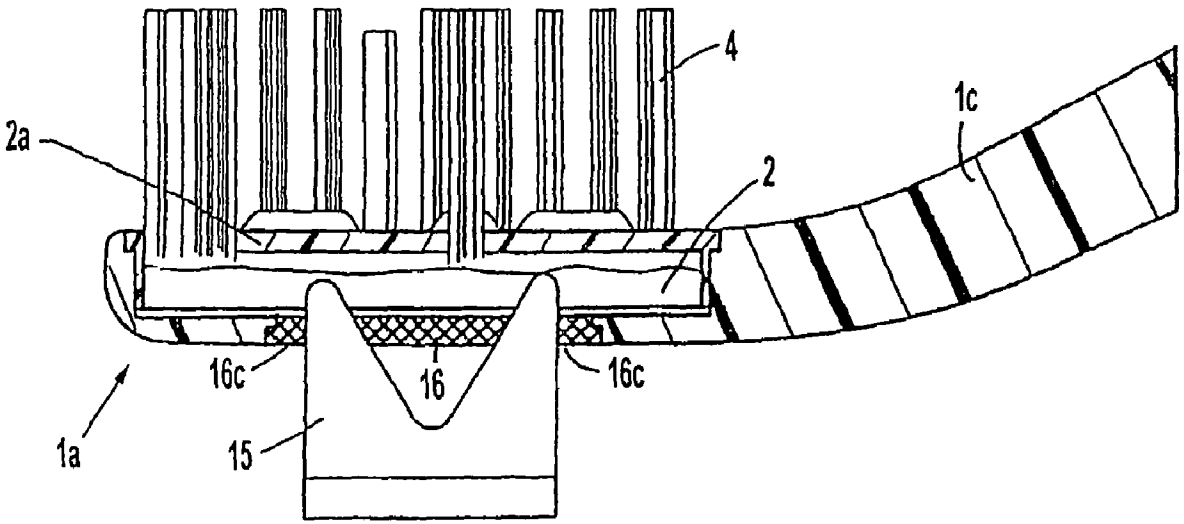
FIG. 11*b* shows a section through the longitudinal center plane of that part of a toothbrush which is depicted in FIG. 11*a*, the toothbrush being subjected to the action of a third assembly-testing device.
Figure 11A:
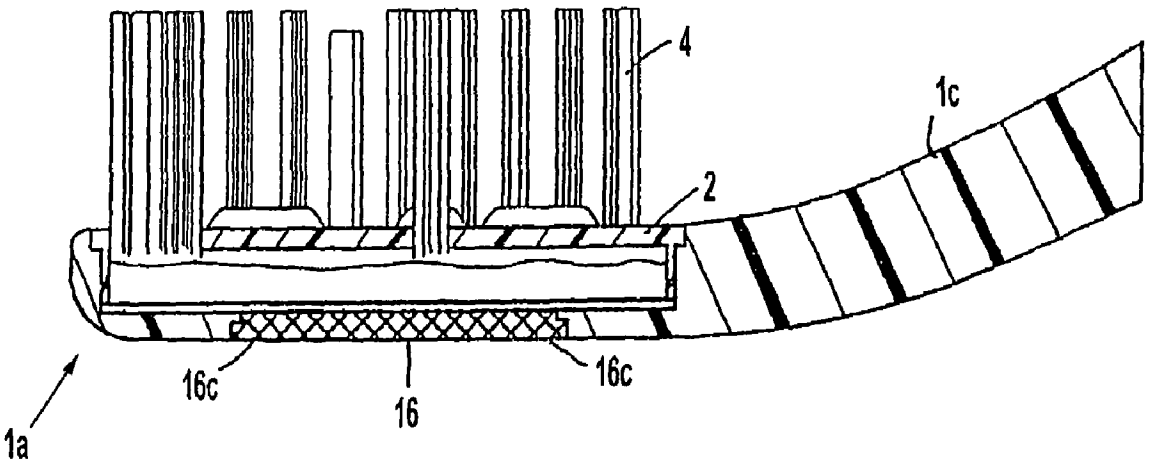
FIG. 11*a* shows a section through the longitudinal center plane of a part of a toothbrush which corresponds to that from FIG. 10*a*, the flexible cleaning elements, for the sake of clarity, not being shown.

FIG. 11*a* shows the front part of a toothbrush analogous to that in FIG. 10*a*, the flexible cleaning elements, for reasons of clarity, not being shown. As can be seen from FIG. 11*b*, the flexible zone 16 is cut through at the border regions 16*c* by means of a double-toothed blade-like element. The compressive force directed essentially orthogonally to the longitudinal axis is thus applied directly to the plate 2*a* of the carrier element. In order to carry out the testing, it is also possible to use other elements, for example a needle-like testing tool. These are designed such that they test the adherence of the carrier plate but damage the flexible material as little as possible.

Figure 12B:
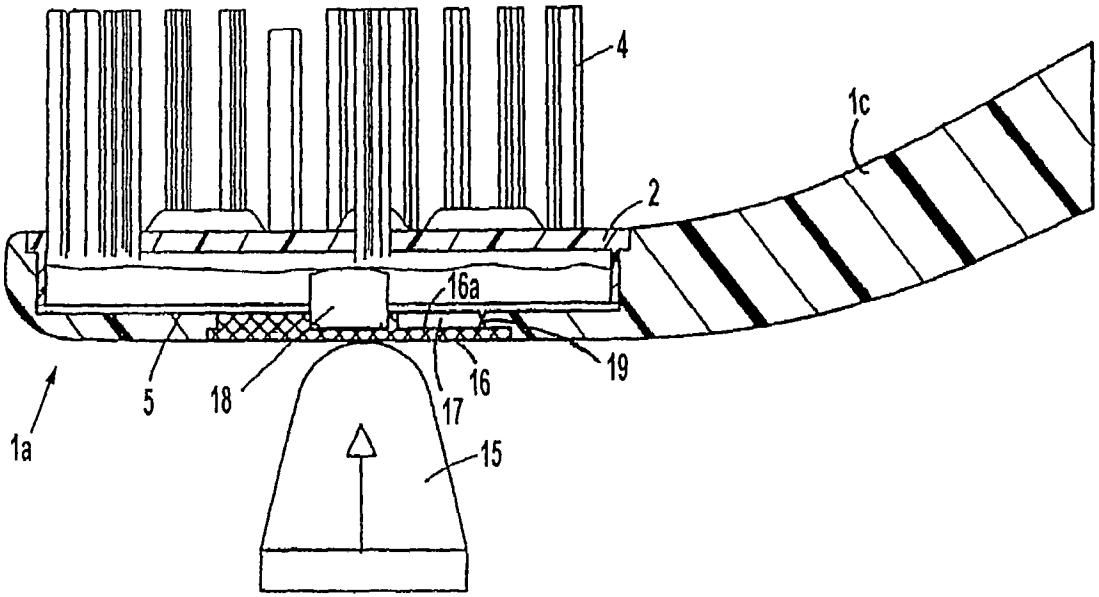
FIG. 12*b* shows a section through the longitudinal center plane of a part of a toothbrush according to the invention which contains the brush body illustrated in FIG. 12*a* and which is subjected to the action of an assembly-testing device.
Figure 12A:
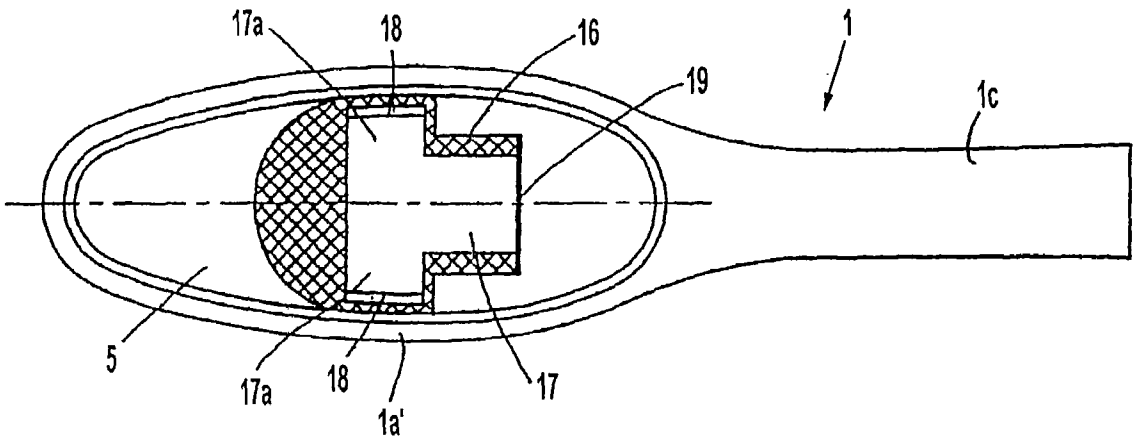
FIG. 12*a* shows the plan view of a part of a brush body in which a flexible region is formed, the flexible cleaning elements, for the sake of clarity, not being shown.

FIG. 12*a* illustrates a front part of the brush body 1 of a toothbrush according to the invention, the flexible cleaning elements, for reasons of clarity, not being shown. In this case, part of the head part 1*a*' of the brush body 1, in the region of the mount 5, consists of flexible material which forms a flexible zone 16. This is of mushroom-shaped configuration in plan view. The hard component of the brush body 1 extends, on the side 16*a* of the flexible zone 16, this side being directed toward the carrier element 2, into a sheet-like structure 17 which is t-shaped in plan view. The t-shaped structure 17 is connected to the rest of the hard component of the brush body via a film hinge 19. Formed at the ends of the shorter arms 17*a* of the t-shaped structure 17 are crosspiece-like extensions 18 which are oriented essentially parallel to the outer contour of the head part 1*a* and/or the side wall 2*b* of the carrier element 2 and orthogonally to the surface area of the mount 5. The compressive force is applied to the flexible zone 16 from the outside in the region of the t-shaped structure 17 and runs essentially orthogonally to the longitudinal axis of the head part 1*a*, as can be seen from FIG. 12*b*. The compressive force is thus transmitted to the plate 2*a* of the carrier element 2 via the sheet-like extensions 18.

Figure 13:
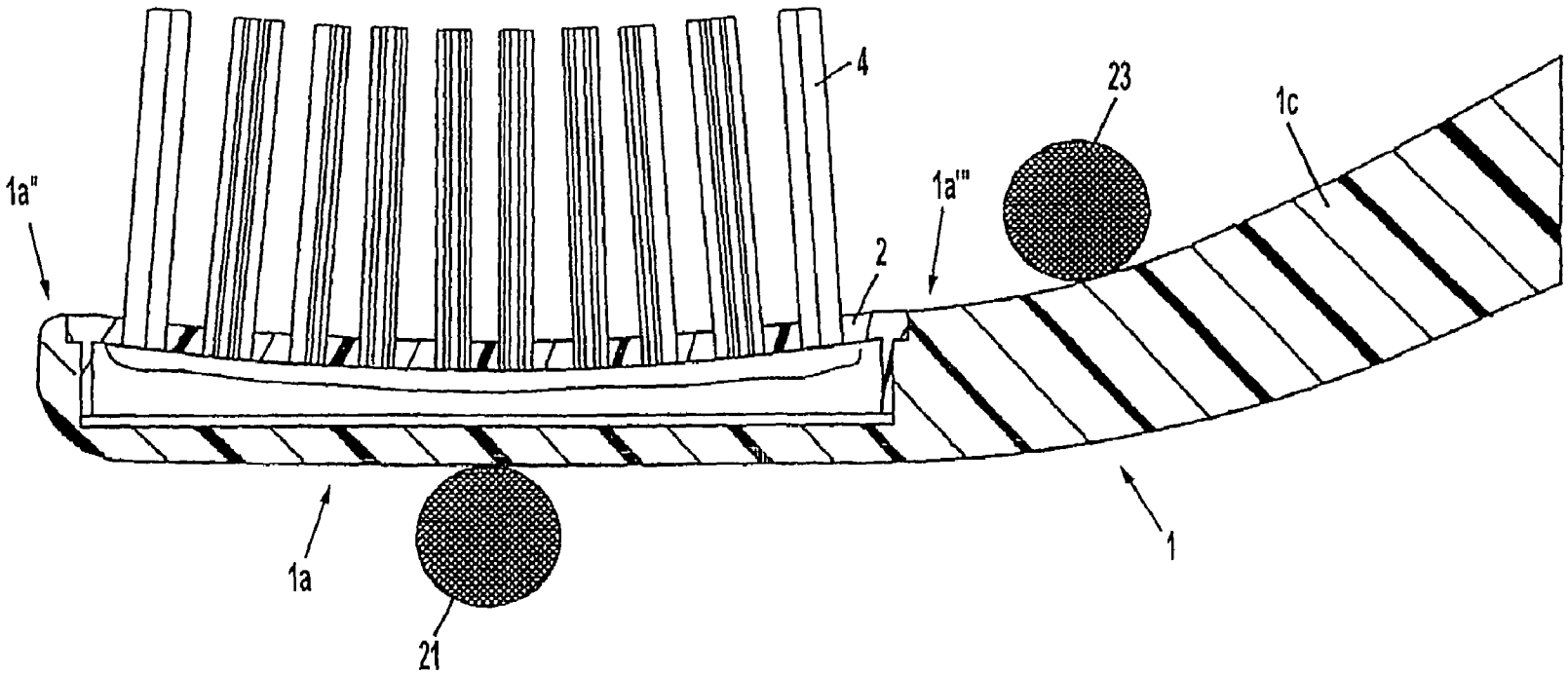
FIG. 13 shows a section through the longitudinal center plane of a part of a toothbrush according to the invention which is subjected to the action of a further assembly-testing device.

FIG. 13 shows the front part of an embodiment in which the adherence of the carrier element to the brush body is checked by virtue of the brush head being bent. For this purpose, the brush body is clamped in between two supports 21, 23, the rear side of the head part 1*a*" being located on the first support 21 and the front side of that region of the neck part 1*c* which is adjacent to the head part 1*a* being located on a second support 23. At the front end 1*a*" of the head part 1*a*, the front side is subjected to a predetermined compressive force by, for example, a test weight of preferably 0.5 to 5 kg, particularly preferably 2 to 3 kg, being positioned thereon. The head part 1*a* is bent as a result, a tensile force acting on the point of connection between the carrier element 2 and brush body 1. If the carrier element 2 provided with bristles 4 becomes detached, at least in part, from the head part 1*a* of the brush body 1, then the adherence is insufficient. The resulting displacement of the carrier element 2 relative to the brush body 1 is determined by means of a, for example, mechanical or optical sensor preferably in the region 1*a*'", which is adjacent to the neck part 1*c* and belongs to the head part 1*a*, the carrier element 2 being connected to the brush body 1 therein.

The above described testing methods may be integrated as a process step in an AFT (Anchor Free Tufting) installation. In this case, toothbrushes which exhibit insufficient adherence between the brush body and carrier element are separated out.

What is claimed is:

1. An electric toothbrush, the electric toothbrush comprising:

a brush body, which has a neck part and an adjoining head part;

conventional bristles; and at least one flexible cleaning element, wherein the conventional bristles are fitted on a rotatable carrier element that is drivable by electric power, includes hard plastic and is connected to the brush body via a mount which is adapted to the carrier element and is located on the head part, and wherein the at least one flexible cleaning element is arranged on the head part and connected directly to the brush body in a non-releasable manner.

2. The electric toothbrush according to claim 1, wherein the mount has a mating element which is shaped to complement the carrier element and is capable of accommodating the carrier element in an essentially accurately fitting manner, and the at least one flexible cleaning element is arranged adjacent to the carrier element.

3. The electric toothbrush according to claim 1, wherein the brush body has at least one further flexible element, and the flexible cleaning element includes the same material as the at least one further flexible element.

4. The electric toothbrush according to claim 3, wherein the further flexible element forms an end zone with a damping action.

5. The electric toothbrush according to claim 3, wherein the further flexible element is designed to increase the elasticity of the brush body.

6. The electric toothbrush according to claim 1, wherein the flexible cleaning element can be made to vibrate relative to the brush body by a movement of the carrier element.

7. The electric toothbrush according to claim 1, wherein a maximum angle of rotation of the carrier element is less than 45°.

8. The electric toothbrush according to claim 1, wherein the carrier element has at least one lateral indent and the flexible cleaning element is arranged on a region of this indent.

9. The electric toothbrush according to claim 1, wherein the cleaning element projects, by way of a region adjacent to a free end, into a bristle arrangement formed by the conventional bristles and is made to vibrate relative to the brush body by movement of the bristles.

10. The electric toothbrush according to claim 1, wherein the brush body has at least one material-distributing channel opening out into the mount, flexible material runs from a mouth opening of the material-distributing channel to a point of attachment for the flexible cleaning element, and the flexible material located in the mount is covered by the carrier element provided with bristles.

11. The electric toothbrush according to claim 1, wherein the conventional bristles are formed from polyamide PA or polyester PBT and the at least one flexible cleaning element is formed from the thermoplastic elastomer TPE.

12. The electric toothbrush according to claim 1, wherein the carrier element is produced from at least one of polypropylene, polyester and acrylonitrile-butadiene-styrene ABS.

13. The electric toothbrush according to claim 1, wherein the brush body forms a plug-on part for electric teeth-cleaning appliances or the electric toothbrush is formed as a single piece.

14. The electric toothbrush according to claim 1, wherein a distance between the flexible cleaning element and the adjacent conventional bristles is less than 5 mm.

15. The electric toothbrush according to claim 1, wherein the flexible cleaning element is rod-shaped or lamellar.

16. The electric toothbrush according to claim 1, wherein the brush body is produced from at least one of polypropylene, polyester and acrylonitrile-butadiene-styrene ABS.

17. An electric toothbrush, the electric toothbrush comprising:

a brush body, which has a neck part and an adjoining head part;

conventional bristles; and at least one flexible cleaning element, wherein the conventional bristles are fitted on a rotatable carrier element that is drivable by electric power, consists of hard plastic and is connected to the brush body via a mount which is adapted to the carrier element and is located on the head part, wherein the at least one flexible cleaning element is arranged on the head part, the mount has a mating element which is shaped to complement the carrier element and is structured to essentially accommodate at least part of the carrier element, and the at least one flexible cleaning element is arranged adjacent to the carrier element.

18. The electric toothbrush according to claim 17, wherein the carrier element has at least one lateral indent and the flexible cleaning element is arranged on a region of this indent.

19. The electric toothbrush according to claim 17, wherein the flexible cleaning element is rod-shaped or lamellar.

20. An electric toothbrush, comprising:

a brush body, which has a neck part and an adjoining head part;

conventional bristles; and at least one flexible cleaning element, wherein the conventional bristles are fitted on a carrier element that is rotatable by electric power and is connected to the brush body via a mount, wherein the at least one flexible cleaning element is arranged on the head part and is made to vibrate relative to the brush body by a movement transmitted from the carrier element.

21. The electric toothbrush according to claim 20, wherein the carrier element has at least one lateral indent and the flexible cleaning element is arranged on a region of this indent.

22. The electric toothbrush according to claim 20, wherein the flexible cleaning element is rod-shaped or lamellar.

23. An electric toothbrush, the electric toothbrush comprising:

a drive transmitting movement to a rotatable carrier element;

a brush body, which has a neck part and an adjoining head part made of a hard plastic material;

conventional bristles; and at least one flexible cleaning element made of a soft plastic material, wherein the conventional bristles are fitted to the carrier element connected to the head part via a mount, and wherein the at least one flexible cleaning element is arranged on the head part and is connected directly to the brush body in a non-releasable manner.

24. The electric toothbrush according to claim 23, wherein the carrier element has at least one lateral indent and the flexible cleaning element is arranged on a region of this indent.

25. The electric toothbrush according to claim 23, wherein the flexible cleaning element is rod-shaped or lamellar.

26. An electric toothbrush, comprising:

a drive transmitting movement to a carrier element;

a brush body, which has a neck part and an adjoining head part;

conventional bristles; and at least one flexible cleaning element, wherein the conventional bristles are fitted to the carrier element that is rotatable and connected to the brush body via a mount, wherein the at least one flexible cleaning element is arranged on the head part and is made to move relative to the brush body by a movement transmitted from the carrier element.

27. The electric toothbrush according to claim 26, wherein the carrier element has at least one lateral indent and the flexible cleaning element is arranged on a region of this indent.

28. The electric toothbrush according to claim 26, wherein the flexible cleaning element is rod-shaped or lamellar.

* * * * *